US005443638A

United States Patent [19]

Gartmann et al.

[11] Patent Number: 5,443,638

[45] Date of Patent: Aug. 22, 1995

[54] DEVICE FOR GENERATING A SUBATMOSPHERIC PRESSURE

[75] Inventors: Uwe Gartmann, Wiesbaden; Hermann Idstein, Oestrich-Winkel; Guenter Hultzsch, Wiesbaden, all of Germany

[73] Assignee: Hoechst Aktiengesellschaft, Frankfurt am Main, Germany

[21] Appl. No.: 109,069

[22] Filed: Aug. 19, 1993

[30] Foreign Application Priority Data

Aug. 22, 1992 [DE] Germany ..... 42 27 908.9

[51] Int. Cl.[6] ..... B05D 1/40

[52] U.S. Cl. ..... 118/50; 118/209; 118/239; 141/65

[58] Field of Search ..... 118/50, 209, 239; 141/65

[56] References Cited

U.S. PATENT DOCUMENTS

| | | | |
|---|---|---|---|
| 2,681,294 | 8/1951 | Beguin | 117/34 |
| 3,640,752 | 2/1972 | Ishiwata et al. | 117/47 |
| 3,735,729 | 5/1973 | Bud | 118/50 |
| 3,916,043 | 10/1975 | Fowble | 427/294 |
| 4,245,583 | 1/1981 | Schollkopf et al. | 118/259 |
| 4,367,691 | 1/1983 | Bergs | 118/119 |
| 4,445,458 | 5/1984 | O'Brien | 118/401 |
| 4,490,418 | 12/1984 | Yoshida | 427/445 |
| 4,545,321 | 10/1985 | Bassa | 118/50 |
| 4,628,856 | 12/1986 | Burgdorf | 118/50 |
| 4,844,002 | 7/1989 | Yasui et al. | 118/259 |

FOREIGN PATENT DOCUMENTS

| | | |
|---|---|---|
| 0038526 | 10/1981 | European Pat. Off. . |
| 0168986 | 1/1986 | European Pat. Off. . |
| 2270952 | 12/1975 | France . |
| 3309343 | 9/1984 | Germany . |
| 57983 | 5/1969 | Luxembourg . |

*Primary Examiner*—Robert J. Warden
*Assistant Examiner*—N. Bhat
*Attorney, Agent, or Firm*—Foley & Lardner

[57] ABSTRACT

A device for generating a subatmospheric pressure at a coating layer on a web-shaped carrier material which is guided over a coating roll. The device is provided with a pressure chamber which is pressurized symmetrically with compressed air via two end-face inflow openings. The compressed air is fed symmetrically to the inflow openings via a manifold unit. From the pressure chamber, the compressed air emerges via a so-called Laval nozzle, thereby generating in a region above the nozzle a subatmospheric pressure which acts on the meniscus of the coating layer during the transition from the gap of the coating die onto the carrier material. Movable seals are provided to permit the width of the nozzle to be adapted to the coating width of the carrier material.

19 Claims, 3 Drawing Sheets

DEVICE FOR GENERATING A SUBATMOSPHERIC PRESSURE

BACKGROUND OF THE INVENTION

The present invention relates generally to a device for generating a subatmospheric pressure, and more particularly, to a device for generating a subatmospheric pressure at a coating layer on a web-shaped carrier material which is guided over a rotating coating roll.

U.S. Pat. No. 4,445,458 discloses an extrusion coating device for applying a coating solution onto a web material moving over a roll. The device employs a drawdown die which has an oblique drawdown surface, the angle between the drawdown surface and the axis of the extrusion slit being an obtuse angle. The extrusion coating device is equipped with a subatmospheric pressure box which, at a relatively high rate of conveyance of the web material, is intended to reduce the entrained air so as not to destroy the contact of the meniscus of the coating solution with the web. The subatmospheric pressure is generated outside the subatmospheric pressure box by means of an evacuating pump which is not described in detail. The structure of the box and the manner in which it is sealed are also not described in detail.

U.S. Pat. No. 2,681,294 describes processes for coating web materials using a slip film coating. The coating devices used each possess a subatmospheric pressure box which is connected to a drainage line in order to drain off excess coating solution. In one embodiment the coating device with the subatmospheric pressure box and a dryer are disposed in a superatmospheric chamber. The subatraospheric pressure box of the coating device has a connection to the ambient air, the cross-section of this connection being controllable so that the differential pressure at the meniscus of the coating solution is adjustable.

The device described in DE-A 3 309 343 for applying at least one casting layer on a moving, web-shaped substrate possesses a rotating casting roll which guides the substrate. A casting device is arranged close to the casting roll, separated only by a gap. A suction device with a housing has a subatmospheric chamber extending from the gap as far as a dividing wall, and a suction chamber extending from the dividing wall as far as an end wall. The dividing wall and/or the end wall are adjustable in the circumferential direction. The subatmospheric pressure chamber and the suction chamber can be connected together via a bypass. By displacing the dividing wall and/or the end wall, the volumes of the subatmospheric pressure chamber and the suction chamber are changed. These volumes, together with the bypass and the gaps to the coating web, form a pneumatic oscillating system. By changing the volumes, resonant frequencies can be changed and, by varying the bypass, the damping can also be changed. In the subatmospheric chamber there is disposed a rotating air roll which represents a source of disturbance for the uniformity of the coating.

Document EP-B 168 986 describes a slip film coating with subatmospheric pressure together with tangential application of the coating solution. The slip film flows downwardly on a perpendicular wall and passes via a gap onto the web to be coated. The web is deflected at this point over a roll so that the coating film lays itself tangentially against the web. The gap is connected to a subatmospheric chamber so that the coating can be influenced. A defined subatmospheric pressure or a defined superatmospheric pressure can be applied via a switch unit. The subatmospheric pressure aids the coating, while the superatmospheric pressure leads to an immediate interruption of the coating. The pressure chambers lies in the direct vicinity of the coating gap between the leading end of the slip web surface and a coating roll over which the web material is guided. The coating gap is at a position with respect to the coating roll such that both the supported web material and the material to be coated move downwardly at this position. The pressure chamber is arranged above the coating gap, and the angle between the lowermost section of the slip web and the tangent onto the coating roll in the region of the coating gap is between 170° and 180°.

In known subatmospheric pressure systems for coating moving webs, the subatmospheric pressure space is separated from standard pressure in the region of the coating roll and of the web material by one or more narrow gaps or by adjacent seals. The adjacent seals can lead to wear or surface defects in the coating roll or the web material. Depending on the gap width, gap seals will allow relatively large amounts of air to enter the sub-atmospheric pressure box. This air must then be removed via the subatmospheric pressure generation system. The amount of air entering the box varies according to the width and thickness of the web material, so that the subatmospheric pressure or the gap seal must be reset in each case. Additionally, the presence of air can cause turbulence and oscillations which in turn can impair the coating meniscus, that is to say the application bead of the coating solution.

In known systems for coating under subatmospheric pressure, there is also the danger that the coating solution can be drawn off when there are instabilities in the subatmospheric pressure system. Drying out of the solution results in coating streaks which can also cause oscillation, again leading to pulsations in the sub-atmospheric box or at the coating meniscus.

Moreover, with a sheet die, high web rates with simultaneously thin coating layers can only be achieved if subatmospheric pressure is applied. The subatmospheric pressure acts from the side of the still uncoated web on the coating film between the die outlet and the web. The subatmospheric pressure is generally generated separately from the coating region via one or more injection nozzles. The air to be drawn out of the subatmospheric pressure box is led via hoses to the injection nozzles. At relatively high subatmospheric pressure, the coating film breaks up between the sheet die and the web and can only be made continuous again at low web rates. The causes of the breaking up are oscillations in the subatmospheric pressure box and in the suction lines, and cross-flows caused by leaking air.

SUMMARY OF THE INVENTION

Accordingly, it is an object of the present invention to provide a device for generating a subatmospheric pressure at a region where a layer of material is being applied to one surface of a web-shaped carrier material.

It is another object of the present invention to provide a device for generating a subatmospheric pressure at a coating layer which is substantially free of oscillation and cross-flows.

It is a further object of the present invention to provide a web coating system with a device for generating a subatmospheric pressure at the coating layer which is substantially free of oscillation and cross-flows.

In accomplishing these and other objects, there has been provided according to one aspect of the invention a device for applying a layer of material to a web-shaped carrier material while creating a subatmospheric pressure at the intersection of the layer of material with the carrier material, comprising a conveyor for conveying a web-shaped carrier material in a conveying direction; means for applying a layer of material to one surface of the web-shaped carrier material, whereby an intersection point is formed where the layer of material is applied to the surface of the carrier material; and means for generating a subatmospheric pressure in a region near the intersection of a web-shaped carrier material and the layer which is being applied onto the carrier material as it is conveyed in the conveying direction, the generating means comprising means for directing a stream of compressed gas in a direction counter to the conveying direction and extending across substantially the entire width of the web-like carrier material, the stream of compressed gas being in communication with the region near the intersection to create a subatmospheric pressure in the region. In a preferred embodiment the layer that is being applied comprises a liquid coating layer.

According to another aspect of the invention, there has been provided a device for generating a subatmospheric pressure at a region near the intersection of a web-shaped carrier material and a coating layer which is being dispensed onto the carrier material as it is conveyed in a conveying direction. The generating means comprises a housing disposed immediately adjacent the carrier material to define between the housing and the carrier material a subatmospheric pressure channel having an originating end communicating with the region and a terminal end, the housing defining therein a pressure chamber. Means are provided for supplying the pressure chamber with compressed gas. An outlet channel leads from the pressure chamber to an opening in the housing, the opening being oriented to extend laterally across substantially the entire width of the carrier material. Means are attached to the housing for directing a flow of the compressed gas in a direction generally opposite to the conveying direction, and diffuser means, integral with the directing means, are provided for tangentially merging the flow of directed compressed gas with the terminal end of the subatmospheric pressure channel, to generate a subatmospheric pressure in the subatmospheric pressure channel.

Other objects, features and advantages of the present invention will become apparent to those skilled in the art when the preferred embodiments of the invention are more fully described below with reference to the drawings.

BRIEF DESCRIPTION OF THE DRAWINGS

The invention is explained in detail below with the aid of the drawings, in which.

DETAILED DESCRIPTION OF THE PREFERRED EMBODIMENTS

Figure 1:
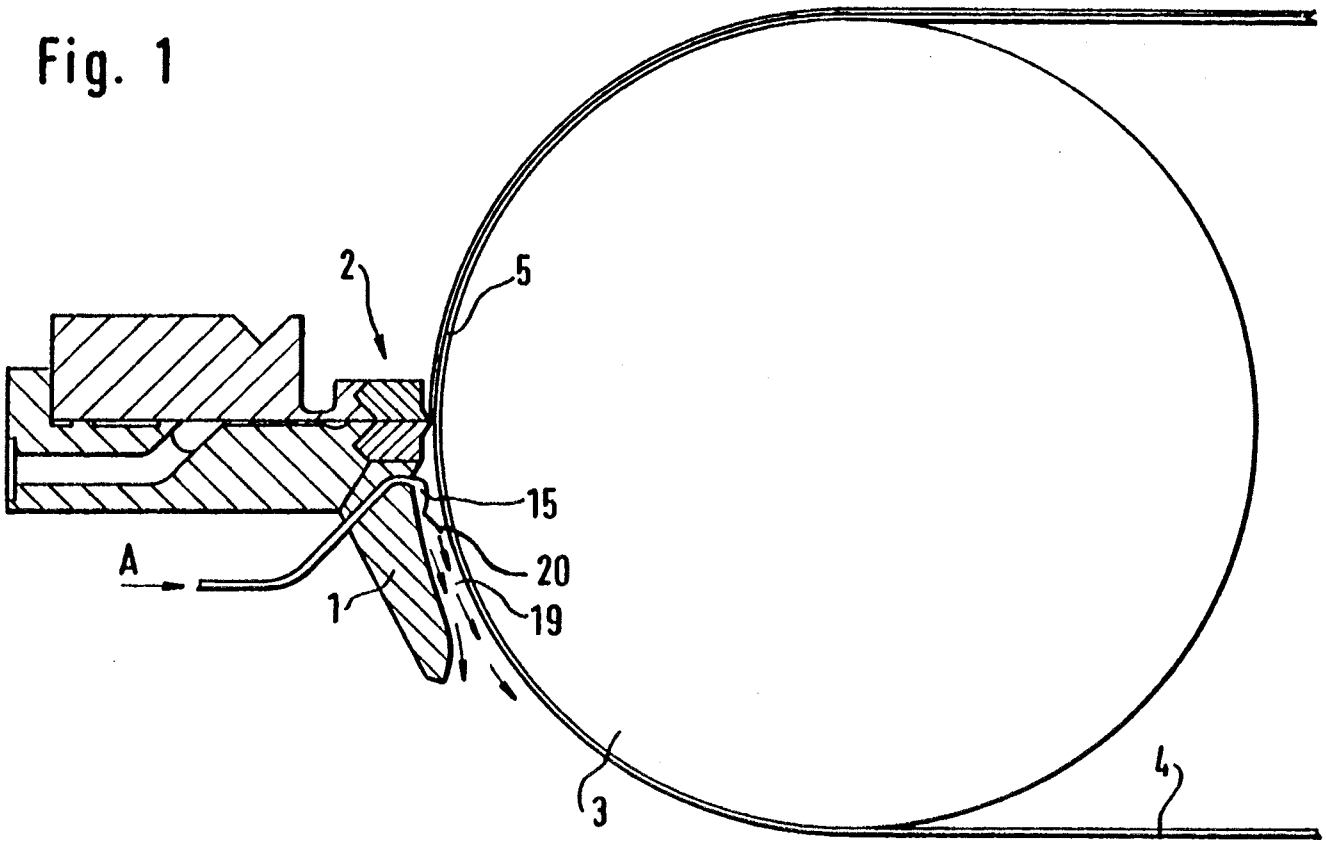
FIG. 1 shows a diagrammatic sectional view of a coating system with the aid of which the principle of subatmospheric pressure generation is described.

According to one aspect of the invention, there is provided a web coating device having means for conveying a carrier material past a coating dispenser, and separate means for generating a subatmospheric pressure near the intersection of the coating layer, the carrier material, and the coating dispenser. The means for generating a subatmospheric pressure is characterized by a housing located upstream of the coating dispenser and containing a pressure chamber therein. An outlet channel leads from the pressure chamber through a nozzle, and joins with a diffusing portion. A subatmospheric channel provides communication between the region fed by the outlet channel and the region defined by the intersection of the carrier material, the coating layer and the coating dispenser. Both the outlet channel and subatmospheric channel preferably extend across the entire width of the carrier material.

In one embodiment the carrier material is conveyed in an upward direction and the outlet channel is arranged a short distance from the material and beneath the coating gap and suction zone. A diffuser part expands the outlet channel downwardly in the direction opposite conveyance.

In a further embodiment, the wall of the subatmospheric pressure channel is formed on the one side by the carrier material as it is conveyed and by a nozzle wall which is secured to the housing with the aid of magnets which are embedded in an upper part of the device. The nozzle wall extends vertically downwardly and is designed so as to be flat.

In still another embodiment, a tapering manifold channel is provided which leads from the pressure chamber to a Laval nozzle which extends over the entire coating width of the carrier material. The diffuser part of the outlet channel then connects at the narrowest cross-section of the Laval nozzle.

Further embodiments of the invention include means for pressurizing the pressure chamber with compressed air at a pressure of 2.5 to 3.8 bar, means for monitoring the pressure in the subatmospheric channel and means for varying the length of the outlet channels.

In accordance with another aspect of the present invention, a coating is provided for a carrier material, whereby carrier material of a given width is transported on a carrier roll and beneath a coating die, and a subatmospheric pressure is generated in a suction zone while a coating layer is applied. The subatmospheric pressure is generated by introducing compressed air into a cavity disposed within a housing having a side which faces the carrier material, and by passing the compressed air from the pressure chamber into a Laval nozzle by means of a manifold channel. The Laval nozzle and manifold channel are also disposed within the housing. The compressed air is expelled from an outlet of the Laval nozzle which is formed on the side of the housing which faces the carrier material. The outlet is formed so as to extend over the entire width of the carrier material, and is further delimited by a nozzle wall disposed on the housing on the side facing the carrier material so as to cause the nozzle to discharge in a direction opposite that in which the carrier material is transported. The compressed air is then diffused with air supplied by a subatmospheric channel defined by the nozzle wall and the carrier material. During the process, a coating layer is applied to the carrier material as it is transported.

With the aid of FIG. 1, the principle of a device 1 for generating a subatmospheric pressure at a coating layer 5 is explained. The subatmospheric pressure generation is based on the principle of the water-jet pump or vapor-jet pump, which is well known. Compressed air is passed through a channel of the device 1 in the direction of arrow A and emerges from a Laval nozzle 15 along the circumference of a coating roll 3. Above the device 1 there is disposed a coating die 2 which applies the coating layer 5 onto a carrier material 4 which is guided or conveyed over a coating roll 3. Because the coating die 2 deposits the coating layer 5 toward the carrier material 4 while it is moving, a meniscus is formed in the region between the coating die 2 and the carrier material 4, that region being referred to as the coating gap. The Laval nozzle 15 is designed in such a manner that only one half of a complete nozzle is used, this half being spatially divided in such a manner that a slit-shaped cross-section is formed which extends over the coating width of the carrier material 4 on the coating roll 3. The plane of symmetry of the Laval nozzle 15 coincides with the inner wall of the device 1 which is opposite the circumferential surface of the coating roll 3. By means of the compressed air emerging from the Laval nozzle 15, a suction or subatmospheric pressure is exerted above the Laval nozzle 15 on the meniscus of the coating layer 5 or on the coating layer as such.

Figure 2:
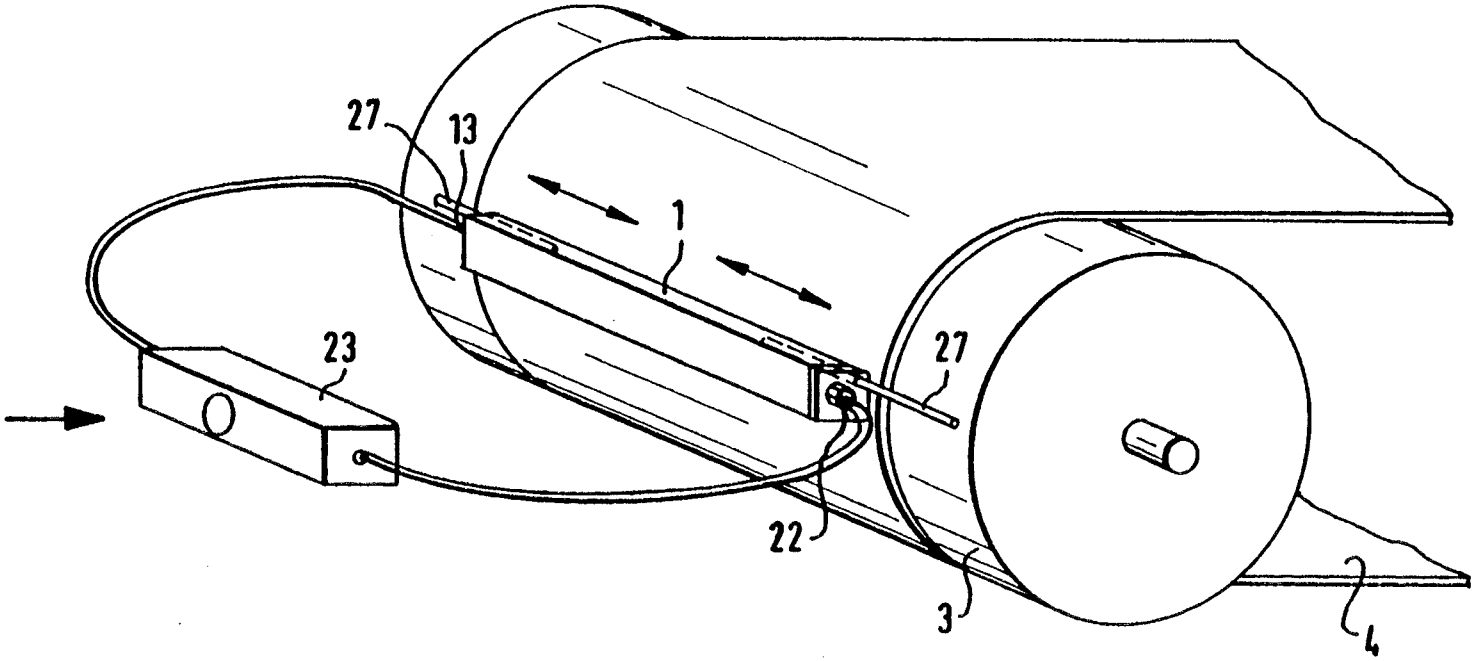
FIG. 2 shows a perspective view of a device for generating a subatmospheric pressure at a coating roll, and the compressed air supply to the device.

FIG. 2 shows a perspective view of the device 1 for generating subatmospheric pressure on a coating roll 3 over which the carrier material 4 to be coated is guided. The device 1 is supplied with compressed air via a manifold unit 23. To this end, compressed air is fed in symmetrically from the manifold unit 23 via inflow openings 13 and 22 of the device 1. Movable seals 27 serve to delimit the outlet width of the compressed air. For reasons of clarity, the coating die 2 is not shown.

Figure 3:
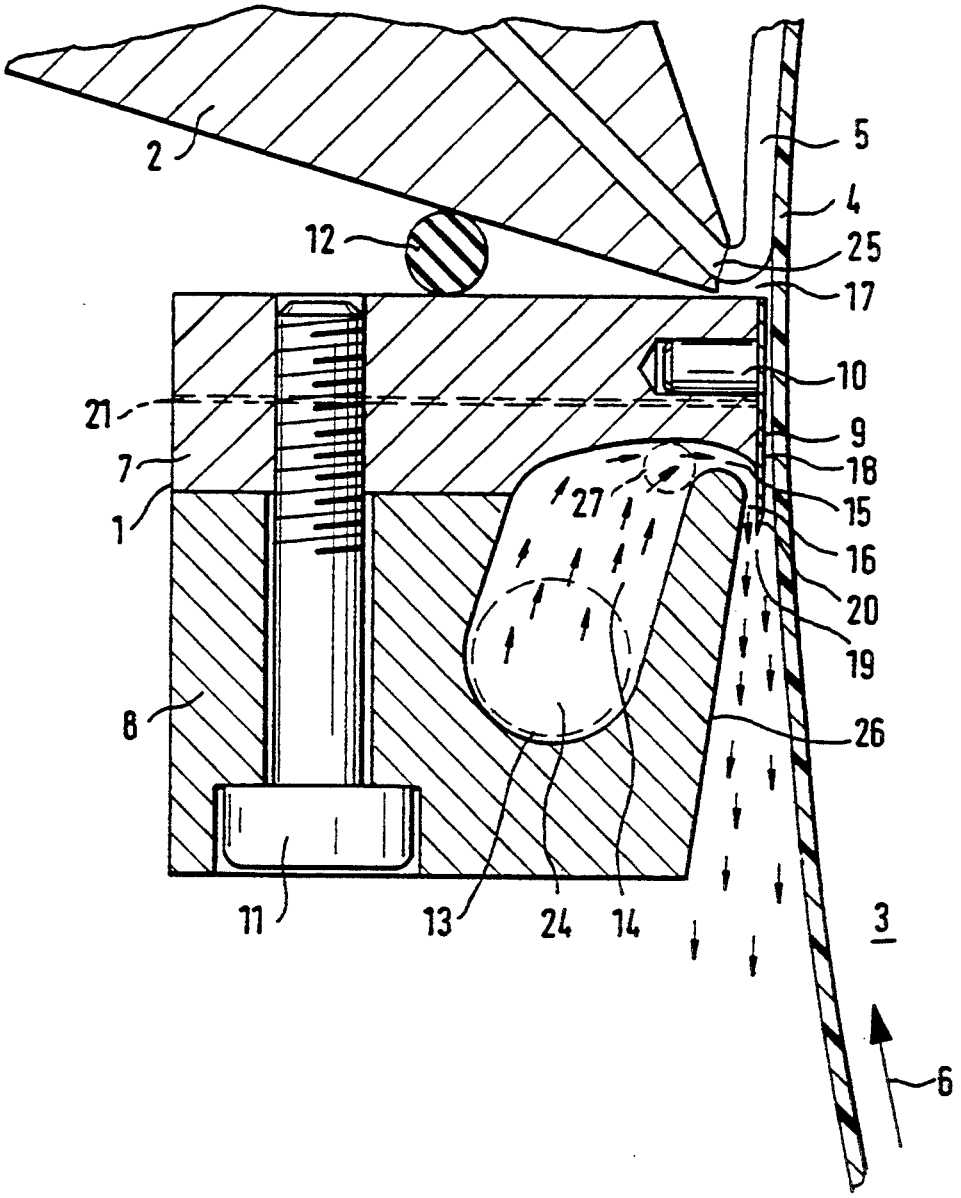
FIG. 3 shows a sectional view of the device according to the invention at a coating roll.

FIG. 3 shows a sectional view of the device 1 as it relates to the coating die 2, carrier material 4, and coating layer 5, which are also shown in section. The carrier material 4, which for example could be a plastic, paper or metal web, is guided or conveyed over the coating roll 3. An arrow 6 indicates the travel direction of the carrier material 4, which moves upwardly over the circumference of the coating roll 3 for purposes of illustration. The coating die 2 is disposed above or downstream of the device 1 relative to the travel direction, so that the coating layer 5 which emerges from the coating die 2 is guided away from the device 1. The device 1, which to a certain extent represents a subatmospheric pressure nozzle, comprises a housing having a lower part 8, an upper part 7 and a nozzle wall 9.

The upper part 7 and the lower part 8 are shown joined together by screws 11. The nozzle wall 9 is shown secured by magnets 10 which are embedded in the upper part 7.

In the interior of the device 1, i.e., in the lower part 8, there is disposed a pressure chamber 24 which has two end-face inflow openings 13, 22 which are opposite one another and via which, as was described with reference to FIG. 2, compressed air is fed in symmetrically. The pressure chamber is pressurized with compressed air of preferably about 2.5 to 3.8 bar. FIG. 3 indicates the inflow opening 13 in the cross-section of the lower part 8. The compressed air flows from the pressure chamber 24, through a manifold channel 14 which tapers upwardly, to the Laval nozzle 15 which extends over the entire coating width. The Laval nozzle 15 is limited by the lower part of the nozzle wall 9 and by the inner wall 26 of the lower part 8 of the device 1. This inner wall 26 is inclined vertically and diverges downwardly and away from the carrier material.

Present in the manifold channel 14 are the movable seals 27 which are indicated diagrammatically by dashed lines in FIG. 3 and which adapt the length of the gap of the Laval nozzle 15 to the coating width on the carrier material 4. The movable seals 27 cover the flow of compressed air to the Laval nozzle 15.

At the narrowest cross-section 16 of the Laval nozzle 15 are a short diffuser part 20 and an outlet channel 19 in which the compressed air flowing out of the Laval nozzle 15 mixes with the air from a subatmospheric pressure channel 18 and with the air molecules entrained by the carrier material 4. The outlet channel 19 is arranged at a distance from and below the coating gap 25 of the coating die 2. The diffuser part 20 merges into the outlet channel 19 which expands downwardly. The subatmospheric pressure channel 18 connects the outlet channel 19 to a suction zone 17 close to the meniscus of the coating layer 5. As previously mentioned the meniscus is formed by the coating layer 5 as it passes from the gap of the coating die 2 onto the carrier material 4.

The walls of the subatmospheric pressure channel 18 are formed on one side by the moving carrier material 4 and on the other by the nozzle wall 9.

The cross-section of the Laval nozzle 15 enlarges towards the diffuser part 20 of the outlet channel 19. The nozzle wall 9 extends vertically downwardly and is designed so as to be flat, whereas the inner wall 26 of the lower part 8 of the device 1, as has already been mentioned above, extends at an incline to the vertical and diverges downwardly. In the upper part 7 of the device 1 is disposed a measuring channel 21 for measuring the subatmospheric pressure prevailing in the subatmospheric pressure channel 18. The prevailing subatmospheric pressure generally amounts to up to about 7 mbar. The subatmospheric pressure occurring in the outlet channel 19 acts via the subatmospheric pressure channel 18 to create a suction zone 17 in the region of the meniscus of the coating layer 5. This stabilizes the coating and makes possible the coating with coating layers possessing a low wet film weight for the first time.

Between the coating die 2 and the device 1 there is disposed a seal 12 which substantially prevents disturbances by preventing the influx of air.

The compressed air fed into the device 1 emerges in such a manner that, laterally of the emergence point, a subatmospheric pressure results, and a flow is thereby exerted on any air layer which adheres to the carrier layer 4.

Although it is not illustrated, the pressure chamber can be subdivided into individually segmented manifold chambers which can then be pressurized as desired with compressed air, so that the length of the nozzle gap of the Laval nozzle can actually be adapted to the particular coating width.

The device 1 can be used not only to generate a subatmospheric pressure at a carrier layer 4 but also to remove air cushions during rolling up of webs or plastic films. It is also possible to expose the compressed air to an alternating current corona discharge, resulting in an ionization of the compressed air which then discharges the upwardly moving carrier material 4 before the coating layer 5 is applied.

The present invention facilitates generation of a subatmospheric pressure directly at or very near the location where it is required, thereby avoiding relatively long paths and, therefore, oscillating air columns. A further advantage of the invention resides in the fact that no sealing is required, thereby avoiding instabilities and eliminating disturbances. Also, because of its simple construction, cleaning of the device can be carried out relatively easily when compared with other known systems.

What is claimed is:

1. A device for generating a subatmospheric pressure at a region near the intersection of a web-shaped carrier material and a coating layer which is being dispensed onto said carrier material as it is conveyed in a conveying direction, comprising a housing disposed immediately adjacent said carrier material to define between said housing and said carrier material a subatmospheric pressure channel having an originating end communicating with said region and a terminal end, said housing defining therein a pressure chamber; means for supplying said pressure chamber with compressed gas; an outlet channel leading from said pressure chamber to an opening in said housing, said opening being oriented to extend laterally across substantially the entire coating width of said carrier material; means attached to said housing for directing a flow of said compressed gas in a direction generally opposite to said conveying direction; and diffuser means, integral with said directing means, for tangentially merging said flow of directed compressed gas with the terminal end of said subatmospheric pressure channel, to generate a subatmospheric pressure in said subatmospheric pressure channel.

2. A device according to claim 1, wherein said subatmospheric pressure channel is defined on one side by the carrier material and on an opposing side by said directing means, said directing means comprising a nozzle wall which is secured to said housing with magnets embedded in said housing.

3. A device according to claim 2, wherein the nozzle wall extends vertically downwardly and is essentially flat.

4. A device according to claim 1, wherein said pressure chamber comprises a main chamber extending axially through said housing and a tapering manifold channel leading from the main chamber to a Laval nozzle which extends over substantially the entire coating width of the carrier material, and the diffuser means is connected at the narrowest cross-section of the Laval nozzle.

5. A device according to claim 1, wherein said means for supplying compressed gas comprises means for pressurizing said pressure chamber with compressed gas at a pressure of about 2.5 to 3.8 bar.

6. A device according to claim 4, wherein the Laval nozzle has a cross-section which enlarges toward the diffuser means.

7. A device according to claim 1, wherein said subatmospheric pressure channel comprises an upper part and a lower part defined by upper and lower parts of said housing which are detachably connected to one another, said upper housing part including a measuring channel for indicating the subatmospheric pressure prevailing in the subatmospheric pressure channel.

8. A device according to claim 5, wherein said means for supplying a compressed gas comprises a manifold unit for feeding compressed gas symmetrically into the pressure chamber via end-face inflow openings located on opposite end faces of said housing.

9. A device according to claim 1, further comprising a seal disposed between the coating die and the housing.

10. A device according to claim 7, wherein the subatmospheric pressure created in the subatmospheric pressure channel is maintained at or below about 7 mbar.

11. A device according to claim 4, further comprising movable seals present in the manifold channel, the movement of said seals adapting the length of the Laval nozzle to the coating width on the carrier material.

12. A device for applying a coating layer onto a rotating web-like carrier material, said device comprising:

means for dispensing a coating layer;

means for conveying a carrier material past said dispensing means, to define an intersection of the coating layer on said carrier material; and means for generating a subatmospheric pressure near the intersection of said coating layer and said carrier material;

wherein said means for generating a subatmospheric pressure comprises a housing :Located upstream of said dispensing means and defining therein a pressure chamber; means for supplying a compressed gas to said pressure chamber; an outlet channel leading from said pressure chamber and having a nozzle portion and a diffusing portion; and a subatmospheric pressure channel defined between said housing and said carrier material and providing fluid communication between a region defined at said intersection and the diffusing portion of said outlet channel, said outlet channel and subatmospheric pressure channel each opening and merging at said diffusing portion against the direction of conveyance and extending across substantially the entire width of said web-like carrier material.

13. A device as claimed in claim 12, further comprising a seal in the region between said housing and said dispensing means.

14. A device as claimed in claim 12, further comprising means for varying the length of said outlet channel.

15. A device for applying a layer of material to a web-shaped carrier material while creating a subatmospheric pressure at the intersection of the layer of material with the carrier material, comprising:

a conveyor for conveying a web-shaped carrier material in a conveying direction;

means for applying a layer of material to one surface of the web-shaped carrier material, whereby an intersection point is formed where the layer of material is applied to the surface of the carrier material; and means for generating a subatmospheric pressure in a region near the intersection of a web-shaped carrier material and the layer which is being applied onto said carrier material as it is conveyed in the conveying direction, said generating means comprising means for directing a stream of compressed gas in a direction counter to the conveying direction and extending across substantially the entire width of said web-like carrier material, said stream of compressed gas being in communication with said region near said intersection to create a subatmospheric pressure in said region.

16. A device as claimed in claim 15, wherein said conveyor comprises a rotating roll.

17. A device as claimed in claim 16, wherein said layer that is being applied comprises a liquid coating layer.

18. A device as claimed in claim 16, wherein said layer that is being applied comprises a layer of said web-like carrier material that is being rolled up on said surface.

19. A device as claimed in claim 16, wherein said generating means comprises a housing disposed immediately adjacent said carrier material to define between said housing and said carrier material a subatmospheric pressure channel having an originating end communicating with said region and a terminal end, said housing defining therein a pressure chamber; means for supplying said pressure chamber with compressed gas; an outlet channel leading from said pressure chamber to an opening in said housing, said opening being oriented to extend laterally across substantially the entire width of said carrier material; means attached to said housing for directing a flow of said compressed gas in a direction generally opposite to said conveying direction; and diffuser means, integral with said directing means, for tangentially merging said flow of directed compressed gas with the terminal end of said subatmospheric pressure channel, to generate a subatmospheric pressure in said subatmospheric pressure channel.

* * * * *